US007892715B2

(12) United States Patent
Okahata et al.

(10) Patent No.: US 7,892,715 B2
(45) Date of Patent: Feb. 22, 2011

(54) COLOR TONER HAVING INORGANIC PIGMENT PARTICLES, GLASS FRIT, AND HEAT DECOMPOSABLE BINDER FOR MAKING A CERAMIC COLOR PRINT

(75) Inventors: Naoki Okahata, Chiyoda-ku (JP); Satoshi Kashiwabara, Chiyoda-ku (JP); Kazuo Sunahara, Chiyoda-ku (JP)

(73) Assignee: Asahi Glass Company, Limited, Tokyo (JP)

( * ) Notice: Subject to any disclaimer, the term of this patent is extended or adjusted under 35 U.S.C. 154(b) by 1047 days.

(21) Appl. No.: 11/529,321

(22) Filed: Sep. 29, 2006

(65) Prior Publication Data

US 2007/0077509 A1 Apr. 5, 2007

(30) Foreign Application Priority Data

Oct. 5, 2005 (JP) ..... 2005-292459

(51) Int. Cl.
*G03G 9/09* (2006.01)

(52) U.S. Cl. ..... 430/109.3; 430/108.6; 430/108.1; 430/124.14; 430/120.2

(58) Field of Classification Search ..... 430/109.3, 430/108.1, 108.6, 124.14, 120.2
See application file for complete search history.

(56) References Cited

U.S. PATENT DOCUMENTS 4,469,625 A 9/1984 Held
5,988,068 A 11/1999 Van Ritter et al.
6,248,492 B1 * 6/2001 Tavernier et al. ..... 430/108.6
6,361,906 B1 * 3/2002 Kawase et al. ..... 430/124.14
7,018,760 B2 * 3/2006 Schultheis et al. ..... 430/108.1
7,026,090 B2 * 4/2006 Aono ..... 430/124.14

FOREIGN PATENT DOCUMENTS

| | | |
|---|---|---|
| EP | 0 851 306 A1 | 7/1998 |
| EP | 1 022 157 A2 | 7/2000 |
| JP | 62-72545 | 4/1987 |
| JP | 11-31416 | 2/1999 |
| WO | WO 03/058351 A1 | 7/2003 |
| WO | WO 2006/006492 A1 | 1/2006 |

OTHER PUBLICATIONS

BASF SICOCER® P Transparent 17025 Product specification, revision 2 (Feb. 2002).*
BASF SICOCER® F Technical Information, pp. 2-5 (May 2000).*
U.S. Appl. No. 12/324,985, filed Nov. 28, 2008, Okahata, et al.
U.S. Appl. No. 12/327,140, filed Dec. 3, 2008, Okahata, et al.
U.S. Appl. No. 12/061,093, filed Apr. 2, 2008, Okahata, et al.

* cited by examiner

*Primary Examiner*—Christopher RoDee
(74) *Attorney, Agent, or Firm*—Oblon, Spivak, McClelland, Maier & Neustadt, L.L.P.

(57) ABSTRACT

A color toner for electro printing, which comprises from 10 to 50 parts by mass of fine inorganic pigment particles, from 5 to 40 parts by mass of a heat decomposable binder resin having an acid value of at least 5, and from 40 to 85 parts by mass of glass frit, per 100 parts by mass of the total solid content of the toner.

10 Claims, 2 Drawing Sheets

COLOR TONER HAVING INORGANIC PIGMENT PARTICLES, GLASS FRIT, AND HEAT DECOMPOSABLE BINDER FOR MAKING A CERAMIC COLOR PRINT

The present invention relates to a color toner for electro printing and a process for producing a glass plate provided with a ceramic color print. Particularly, it relates to a color toner for electro printing capable of forming a ceramic color print excellent in adhesion to a glass plate to be used for a window of e.g. an automobile and a process for producing a glass plate provided with a ceramic color print.

On a glass plate to be used for a window of an automobile, a ceramic color print is provided to be interposed between a window glass and a urethane sealant which holds the window glass at its periphery from the car interior side. Such a ceramic color print is provided mainly on peripheral regions of a fixed window of an automobile on the car interior side, and has functions to prevent deterioration of the urethane sealant due to ultraviolet rays and to prevent terminals of heating wires, etc. provided on peripheral portions of the window glass on the car interior side from being seen from the car exterior side. Further, in recent years, a ceramic color print having a pattern of fine dots formed by gradation, for the purpose of improving the design, has been widely used.

A ceramic color print is made of a fired product of a paste-mainly containing fine inorganic pigment particles (hereinafter referred to as an inorganic pigment paste). Specifically, a paste comprising heat resistant fine inorganic pigment particles and glass frit contained in a resin solution is printed on a glass plate with a predetermined pattern by screen printing, and the glass plate is heated, so that the resin content is is decomposed, and the fine inorganic pigment particles are fixed on the glass plate by the glass frit to provide a ceramic color print on the glass plate (for example, JP-A-62-72545). Here, as the heat resistant fine inorganic pigment particles, usually black ones are employed.

Since automobiles are mass-produced, glass plates for windows to be used for automobiles are also mass-produced. Therefore, with respect to the ceramic color print also, once the pattern is determined, it is required that the inorganic pigment paste is sequentially printed on a large number of glass plates in accordance with the determined pattern. For such mass production, screen printing of the inorganic pigment paste by means of a screen printing plate is suitable. However, e.g. in a case where a glass plate is used for a window of an automobile, the shape of the glass plate, the shape of the ceramic color print, etc. vary depending upon the models of automobiles. Accordingly, screen printing plates must be prepared depending upon the models of automobiles, and a large number of screen printing plates must be stored. Thus, development of a process for producing a glass plate provided with a ceramic color print, which requires no modification of the screen printing plate, and a ceramic color composition therefor, has been required.

Whereas, in recent years, formation of a color print in such a manner that a color toner (ink) containing fine inorganic pigment particles and a thermoplastic resin is printed on a transfer sheet for ceramics by electro printing system, and the transfer sheet is adhered to the surface of an inorganic substrate, followed by firing, and a color toner therefor, have been proposed. As a representative example thereof, EP1022157 proposes a process of using a color toner having a thermoplastic resin added to a colorant obtained by mixing and melting fine inorganic pigment particles such as carbon black and glaze frit, followed by cooling and pulverization. However, EP1022157 has had such drawbacks that since a step is essential that a toner image is transferred on a coating comprising a water soluble polymer on the surface of the transfer sheet, and the toner image held on the coating is separated from the transfer sheet and then retransferred on a substrate, and thus the process is complicated, and the transfer rate itself tends to decrease. Further, for the color toner, a large amount of a thermoplastic resin such as a polyester resin, a polystyrene resin or a styrene acrylic resin is used, and accordingly the resin tends to remain as chars in the ceramic color print after firing, and as a result, no ceramic color print excellent in adhesion to the surface of an inorganic substrate is likely to be obtained.

Under these circumstances, it is an object of the present invention to provide a color toner for electro printing and a process for producing a glass plate provided with a ceramic color print, particularly to provide a color toner capable of forming a ceramic color print excellent in adhesion to a glass plate to be used for a window of e.g. an automobile, and a process for producing a glass plate provided with a ceramic color print.

The present invention provides a color toner for electro printing as disclosed in the following (1) to (7) and a process for producing a glass plate provided with a ceramic color print as disclosed in the following (8) to (10).

(1) A color toner for electro printing, which comprises from 10 to 50 parts by mass of fine inorganic pigment particles, from 5 to 40 parts by mass of a heat decomposable binder resin having an acid value of at least 5, and from 40 to 85 parts by mass of glass frit, per 100 parts by mass of the total solid content of the toner (hereinafter referred to as a first aspect of the present invention).

(2) A color toner for electro printing, which comprises fine inorganic pigment particles, a heat decomposable binder resin having an acid value of at least 5, and glass frit, characterized in that the mass ratio of the glass frit to the heat decomposable binder resin in the toner is such that (the glass frit)/(the heat decomposable binder resin)$\geqq$1.5 (hereinafter referred to as a second aspect of the present invention).

(3) The color toner for electro printing according to (1) or (2), wherein the mass ratio of the glass frit to the fine inorganic pigment particles in the toner is such that (the glass frit)/(the fine inorganic pigment particles)$\geqq$1.

(4) The color toner for electro printing according to any one of (1) to (3), wherein the heat decomposable binder resin having an acid value of at least 5 is an acid-modified thermoplastic resin obtained by reacting an unsaturated carboxylic acid or an unsaturated carboxylic anhydride with a thermoplastic resin.

(5) The color toner for electro printing according to (4), wherein the acid-modified thermoplastic resin is a maleic anhydride-modified thermoplastic resin.

(6) The color toner for electro printing according to (4) or (5), wherein the acid-modified thermoplastic resin is a maleic anhydride-modified polyolefin.

(7) The color toner for electro printing according to any one of (1) to (6), wherein the heat decomposable binder resin having an acid value of at least 5 is a heat-decomposable resin having a $T_{100}$ of from 350 to 550° C., provided that $T_{100}$ is a temperature when, at the time of raising the temperature from room temperature at a heating rate of 10° C./min by using a thermogravimetric analyzer (TG), there is no longer a change in the weight.

(8) A process for producing a glass plate provided with a ceramic color print, which comprises a step of forming, by using the color toner as defined in any one of (1) to (7), a pattern of the color toner by electro printing system on a glass plate, and a step of heating the glass plate having a pattern of the color toner formed thereon to convert the color toner into a ceramic thereby to produce a glass plate having a pattern of a ceramic color print.

(9) The process for producing a glass plate provided with a ceramic color print according to (8), wherein the temperature at which the glass plate is heated is from 600 to 740° C.

(10) The process for producing a glass plate provided with a ceramic color print according to (8) or (9), wherein the glass plate having a pattern of the color toner formed thereon is heated to convert the color toner into a ceramic, and the heated glass plate is subjected to thermal processing.

According to the present invention, a color toner for electro printing is printed on a glass plate with a predetermined pattern by electro printing, followed by firing to provide a ceramic color layer with a predetermined pattern on the glass plate, and thus a ceramic color print excellent in adhesion to a glass plate can be formed without preparing a screen printing plate for each pattern. Particularly, it is possible to cope with a change of the pattern or the screen printing plate only by replacement of electro information, and thus it is possible to cope with production of a wide variety of products in small quantities in a short period of time.

Now, the present invention will be described in detail with reference to the preferred embodiments.

In the present invention, electro printing means printing by means of xerography system. The xerography system is based on such a system that an electrostatically charged photoconductor drum is exposed to form an electrostatic latent image, the latent image is developed with a toner to form a pattern of the toner on the surface of the photoconductor drum, and then the pattern of the toner is transferred to the surface of a substrate (the surface of a glass plate in the case of the present invention). The present invention is an invention relating to a color toner suitable for such electro printing. The color toner is used for formation of a ceramic color print (print pattern formed from molten glass frit containing fine inorganic pigment particles) by firing a pattern of the electronically printed toner. Particularly, the color toner is a color toner suitable for production of a glass plate provided with a ceramic color print in such a manner that a print pattern comprising the color toner is formed on the surface of a glass plate by electro printing, and the print pattern of the color toner on the surface of the glass plate is fired and converted into a ceramic color print. The present invention further provides a process for producing a glass plate provided with a ceramic color print by using such a color toner.

Now, the present invention will be described with reference to drawings.

Figure 1:
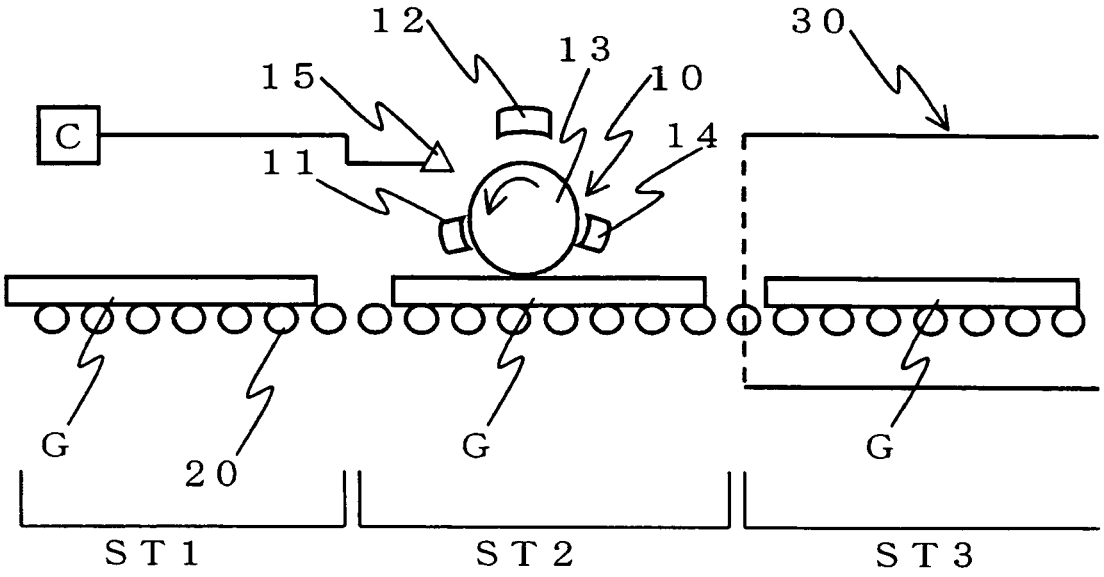
FIG. 1 is a side view schematically illustrating one example of a series of steps for production of a glass plate provided with a ceramic color print of the present invention.

FIG. 1 is a side view schematically illustrating one example of a series of steps for production of a glass plate provided with a ceramic color print of the present invention. A glass plate G is subjected to a step (ST1) of cutting it into a predetermined shape, followed by chamfering, cleaning, etc. and then carried to a printing step (ST2). In the printing step ST2, a color toner containing fine inorganic pigment particles is printed on the surface of the glass plate G with a predetermined pattern by an electro printing apparatus 10. The glass plate G having the toner printed thereon with a predetermined pattern is carried into a heating furnace 30. In the heating furnace 30, the glass plate G is heated at a predetermined temperature, and the toner is baked on the glass plate G to produce a glass plate provided with a ceramic color print with a predetermined pattern. The formed ceramic color print is carried to an inspection step (ST4, not shown) to inspect shielding properties. Inspection results in the inspection step ST4 are transmitted to a computer C to judge whether desired shielding properties are achieved, and then converted to information for adjustment of the predetermined pattern or the toner supply amount, which are utilized to control the print pattern in the printing step ST2.

In the step ST1, a rectangular glass plate is cut into a predetermined shape, and the cut surfaces are chamfered. Then, the glass plate is cleaned, pre-heated as the case requires, and carried to the printing step ST2 by means of carrier rolls 20.

In the printing step ST2, electricity on a photoconductor drum 13 is removed by a destaticizer 14 while the photoconductor drum 13 is rotated, and then the photoconductor drum 13 is electrified by an electrification apparatus 12, and the photoconductor drum 13 is irradiated with exposure light from a light source 15 and exposed with a predetermined pattern. Then, the exposed plane of the photoconductor drum 13 is rotated to a toner supplier 11, and a toner is supplied to the photoconductor drum 13, whereby a toner layer with a predetermined pattern is formed on the surface of the photoconductor drum 13. The toner layer with a predetermined pattern on the surface of the photoconductor drum 13 is transferred on the surface of the glass plate G carried along with rotation of the photoconductor drum 13. In such a manner, a toner layer with a predetermined pattern is formed on the surface of the glass plate G. On that occasion, a secondary transfer plate such as an intermediate transfer belt may be present between the photoconductor drum 13 and the glass plate G.

In the computer C, pattern information for exposure with a predetermined pattern by irradiation with exposure light is stored. Accordingly, by a command from the computer C, exposure light is applied with a predetermined pattern from the light source 15. In a case where the glass plate G is used for a window of an automobile, etc., the shape of the glass plate, the pattern shape of the ceramic color print, etc. vary depending upon the models of automobiles. Accordingly, it is possible to easily change production of glass plates for a certain model to production of glass plates for another model by changing command signals based on the data depending upon the models of automobiles.

The glass plate G having a toner layer with a predetermined pattern is carried into a heating furnace 30 and heated at a predetermined temperature, usually at from about 600 to about 740° C. In the furnace, the toner is baked on the surface of the glass plate G to provide a ceramic color print with a predetermined pattern on the glass plate. Since a glass plate for a window of an automobile is usually curved, when a glass plate provided with a ceramic color print produced as mentioned above is used for a window of an automobile, it is heated in a firing step ST3 and subjected to tempering treatment via bending. Here, annealing treatment, not tempering treatment, may be carried out in some cases (bending of a glass plate for laminated glass). Thermal processing of a glass plate means heating a glass plate to carry out bending or tempering treatment.

The color toner for electro printing of the present invention (hereinafter referred to as the present toner) which can be used for the above process comprises particles containing fine inorganic pigment particles, a heat decomposable binder resin having an acid value of at least 5 (hereinafter referred to as the present binder resin) and glass frit. In this case, before heating, the present toner is fixed to the surface of a glass plate due to stickiness of the present binder resin. Then, in the heating process, first, the present binder resin is decomposed. The decomposed binder resin is volatilized from the glass plate by heating. After most of the present binder resin is volatilized, the glass frit starts to melt, and the present toner is fixed on the surface of the glass plate mainly due to stickiness of the glass frit. In such procedure, the present binder resin is made to be completely decomposed and volatilized until the glass frit is completely melted, whereby remaining of chars in the ceramic color print after firing can be suppressed. Finally, the glass plate is heated to a temperature exceeding 600° C., whereby molten frit in which the fine inorganic pigment particles are dispersed forms a layer on the surface of the glass plate.

The fine inorganic pigment particles are an essential component to block ultraviolet rays or to block visible light also, and a heat resistant pigment is preferably used. In order to obtain a black pattern, preferred is at least one oxide selected from the group consisting of Co, Cr, Mn, Fe and Cu, or a composite oxide of two or more of them. Specifically, it is particularly preferred to use at least one heat resistant pigment selected from the group consisting of Cu—Cr—Mn composite oxide, Cr—Co composite oxide, Fe—Mn composite oxide, Cr—Fe—Ni composite oxide, Cr—Cu composite oxide and magnetite, which are excellent in black color development properties.

The fine inorganic pigment particles preferably have an average particle size of from 0.2 to 5 μm. When the average particle size is at lest 0.2 μm, shielding properties in the interior of the ceramic color print to be obtained can be maintained, whereby it is possible to prevent glass from being seen through the printing surface. Further, when the average particle size is at most 5 μm, high print quality of the ceramic color print to be obtained can be achieved. The fine inorganic pigment particles particularly preferably have an average particle size of from 0.5 to 3 μm.

For the present toner, as a binder resin which has favorable adhesion to a glass plate and which has favorable decomposability at the time of heat treatment, the present binder resin is employed. The reason why favorable fixing properties are achieved by the present binder resin is not accurately understood, but is considered to be because carboxyl groups in the present binder resin interact with silanol groups on the surface of the glass plate. Here, by the acid value of the present binder resin being at least 5, the above interaction will sufficiently occur, and accordingly when the present toner is electronically printed on the glass plate, fixing properties of the print will be stabilized. It is considered that failure of adhesion of the ceramic color print will less likely to occur after firing, and a print having favorable adhesion properties can be formed resultingly. Further, the acid value is preferably at most 100, whereby the present toner can be sufficiently fixed on the glass plate at the time of electro printing, and failure such as offset on a transfer roll is less likely to occur. The acid value is particularly preferably from 20 to 80. The acid value represents mg of potassium hydroxide required to neutralize acid groups present in 1 g of the resin.

The present binder resin is preferably a heat decomposable resin containing as the main component an acid-modified thermoplastic resin having an acid value of at least 5. The present binder resin may comprise an acid-modified thermoplastic resin alone or may be a combination of an acid-modified thermoplastic resin with another heat decomposable resin (such as a thermoplastic resin having no acidic group). In the latter case, the proportion of the heat decomposable resin other than the acid-modified thermoplastic resin is preferably relatively small to the acid-modified thermoplastic resin. The proportion is preferably at most 30 mass %, particularly preferably at most 10 mass % to the total resin amount of the present binder resin. Each of the polymer in the main chain of the acid-modified thermoplastic resin and the polymer in the main chain of another heat decomposable resin is preferably a polymer obtained by vinyl polymerization. The main chain skeletons of them may be the same or different from each other. Even when another heat decomposable resin is contained, the acid value of the present binder resin is at least 5, and the acid value of the entire resin including another heat decomposable resin having no acidic group is at least 5. Further, the acid-modified thermoplastic resin or another heat decomposable resin for the present binder resin may be commercial products.

The acid-modified thermoplastic resin is a polymer having acidic groups, and acidic groups in the present invention mean carboxyl groups and carboxylic anhydride groups. The acid-modified thermoplastic resin is a thermoplastic resin having either or both of carboxy groups and carboxylic anhydride groups. The acid-modified thermoplastic resin is preferably a polymer obtained by copolymerization of monomers having an acidic group or a polymer obtained by reacting a compound having an acidic group with a thermoplastic resin. Further, it is possible to hydrolyze a polymer obtained by copolymerizing unsaturated carboxylate monomers to obtain an acidic group-containing polymer. The acid-modified thermoplastic resin in the present invention is particularly preferably an acid-modified thermoplastic resin obtained by reacting a compound having an acidic group with a preliminarily produced thermoplastic resin.

The chief monomer constituting the acid-modified thermoplastic resin may, for example, be an olefin, an aromatic vinyl monomer such as styrene, a (meth)acrylate monomer such as an acrylate or a methacrylate, an unsaturated alcohol ester monomer such as vinyl acetate, or a diene monomer such as butadiene. Particularly preferred is a thermoplastic resin obtained by employing, as the chief monomer, an olefin having at most 6 carbon atoms such as ethylene or propylene.

The compound having an acidic group (hereinafter referred to as an acid modifier) is preferably an unsaturated carboxylic acid or an unsaturated polycarboxylic anhydride. Particularly preferred is an unsaturated dicarboxylic acid or an unsaturated dicarboxylic anhydride. Specifically, it may, for example, be acrylic acid, methacrylic acid, maleic acid, fumaric acid, itaconic acid, citraconic acid, maleic anhydride, itaconic anhydride or citraconic anhydride. Particularly, as an acid modifier, maleic anhydride is preferred. Thus, the acid-modified thermoplastic resin is preferably an acid-modified thermoplastic resin obtained by reacting an unsaturated carboxylic acid or an unsaturated carboxylic anhydride with a thermoplastic resin, particularly preferably a maleic anhydride-modified thermoplastic resin.

The acid-modified thermoplastic resin is preferably an acid-modified polyolefin obtained by reacting a compound having an acidic group with a polyolefin. The polyolefin may, for example, be a polyethylene, a polypropylene or an ethylene/propylene copolymer, and among them, a polypropylene is preferred with a view to easily securing a stable amount of electrification as the toner. A method of reacting an acid modifier with a polyolefin may, for example, be a method of mixing an acid modifier and a radical generator (such as a peroxide) with a polyolefin, followed by heating to react them, or a method of mixing an acid modifier with a polyolefin having its molecular weight lowered (having reaction sites such as unsaturated groups) preliminarily obtained by partial heat decomposition of a polyolefin, to react them. The acid-modified polyolefin is preferably a maleic anhydride-modified polyolefin obtained by the above methods employing maleic anhydride as an acid modifier, particularly a maleic anhydride-modified polypropylene, in view of the level of the mount of electrification, the speed of rising of the electrification and stability of the charge. The weight average molecular weight of the acid-modified polyolefin is not particularly limited but is preferably from 3,000 to 150,000, particularly preferably from 5,000 to 80,000.

Further, the glass frit may be either lead glass or non-lead glass, but preferred is non-lead bismuth-silica glass frit in view of environment, etc. Further, the glass frit is preferably a powder having an average particle size of from 0.1 to 5 μm. When the glass frit has an average particles size of at least 0.1 μm, adhesion to the glass plate can be sufficiently secured, and when the average particle size is at most 5 μm, exposure of the glass frit on the surface of the present toner particles can be prevented, whereby the fixing properties are less likely to decrease when the toner is printed on the glass plate by electro printing system. The glass frit particularly preferably has an average particle size of from 0.5 to 3 μm. The glass transition temperature Tg of the glass frit is preferably from 350 to 500° C. When Tg is at least 350° C., melting of the glass frit before decomposition of the resin can be prevented, whereby baking failure of the ceramic color print, i.e. failure of agglomeration of the fine inorganic pigment particles and failure of adhesion of the ceramic color print can be reduced. Further, when Tg is at most 500° C., it is possible to prevent the resin from being decomposed and volatilized before the glass frit is melted, whereby the fixing properties of the present toner will not decrease, and the adhesion of the ceramic color print to the glass plate can be secured.

The color toner for the electro printing according to the first aspect of the present invention comprises from 10 to 50 parts by mass of the fine inorganic pigment particles, from 5 to 40 parts by mass of the present binder resin and from 40 to 85 parts by mass of the glass frit per 100 parts by mass of the total solid content of the present toner. Further, the color toner for electro printing according to the second aspect of the present invention also preferably comprises from 10 to 50 parts by mass of the fine inorganic pigment particles, from 5 to 40 parts by mass of the present binder resin and from 40 to 85 parts by mass of the glass frit.

When the content of the fine inorganic pigment particles is at least 10 parts by mass, sufficient shielding properties as viewed from the printing surface can be developed. Further, when the content of the fine inorganic pigment particles is at most 50 parts by mass, the adhesion of the ceramic color print to the glass plate can be secured. The content of the fine inorganic pigment particles is particularly preferably from 15 to 40 parts by mass. Further, when the content of the present binder resin is at least 5 parts by mass, the ceramic color print can be fixed to the glass plate due to stickiness of both of the resin and the glass frit, and the adhesion of the ceramic color print to the glass plate can be increased. Further, when the content of the present binder resin is at most 40 parts by mass, chars are less likely to remain in the ceramic color print after firing, and the adhesion of the ceramic color print to the glass plate can be sufficiently secured for a long period of time. Further, it is possible to prevent occurrence of defects such as cracks and voids in the ceramic color print by decomposition of the resin. The content of the present binder resin is particularly preferably from 10 to 30 parts by mass. Further, when the content of the glass frit is at least 40 parts by mass, the adhesion of the ceramic color print to the glass plate can be sufficiently secured for a long period of time, and when the content is at most 85 parts by mass, the fine inorganic pigment particles can be dispersed at a high concentration in the ceramic color print, whereby shielding properties as the pattern can be easily obtained. The content of the glass frit is preferably from 45 to 80 parts by mass per 100 parts by mass of the total solid content of the present toner.

Further, in the color toner for electro printing according to the second aspect of the present invention, the content ratio of the glass frit to the present binder resin is such that by the mass ratio, (the glass frit)/(the present binder resin)≧1.5. Further, in the color toner for electro printing according to the first aspect of the present invention also, the content ratio of the glass frit to present binder resin is preferably such that by the mass ratio, (the glass frit)/(the present binder resin)≧1.5. According to the first and the second aspects of the present invention, the content ratio of the glass frit to the present binder resin is more preferably 2 or higher. By such a ratio, chars are less likely to remain in the ceramic color print after firing, and the adhesion of the ceramic color print to the glass plate can be sufficiently secured for a long period of time. Further, it is possible to prevent occurrence of defects such as cracks and voids in the ceramic color print by decomposition of the resin. Further, in the first and second aspects of the present invention, the upper limit of the content ratio of the glass frit to the present binder resin is preferably at most 10, that is, by the mass ratio, (the glass frit)/(the present binder resin)≦10. It is more preferably at most 8. By such a ratio, since a small amount of the present binder resin remains even when the glass frit starts melting, the ceramic color print can be fixed to the glass plate due to stickiness of both of the resin and the glass frit, and the adhesion of the ceramic color print to the glass plate can be increased. The content ratio of the glass frit to the present binder resin is particularly preferably such that by the mass ratio, (the glass frit)/(the present binder resin)=2 to 8.

Further, in the first and second aspects of the present invention, the content ratio of the glass frit to the fine inorganic pigment particles is preferably such that by the mass ratio, (the glass frit)/(the fine inorganic pigment particles)≧1. By such a ratio, the fine inorganic pigment particles can be highly dispersed in the ceramic color print and further can be firmly fixed to the glass plate, whereby the adhesion of the ceramic color print to the glass plate can be sufficiently secured for a long period of time. Further, it is possible to prevent occurrence of defects such as cracks and voids in the ceramic color print by decomposition of the resin. Further, the upper limit is preferably at most 5, i.e. (the glass frit)/(the fine inorganic pigment particles)≦5. By such a ratio, it is possible to obtain a ceramic color print having a desired color tone and excellent in shielding properties. The content ratio of the glass frit to the fine inorganic pigment particles is particularly preferably such that by the mass ratio, (the glass frit)/(the fine inorganic pigment particles)=1.5 to 4.

The present binder resin preferably has a $T_{100}$ of from 350 to 550° C. In the present invention, $T_{100}$ is a temperature when, at the time of raising the temperature from room temperature at a heating rate of 10° C./min by using a thermogravimetric analyzer (TG) to measure the change in the weight of the resin, there is no longer a change in the weight. When $T_{100}$ is at least 350° C., it is possible to prevent glass frit from melting before decomposition of the resin, whereby the ceramic color print can be sufficiently fixed to the glass plate. Further, when $T_{100}$ is at most 550° C., on the contrary, the resin will be quickly decomposed and volatilized when the toner is baked, whereby the resin will hardly remain as residual carbon in the ceramic color print, and it is thereby possible to obtain a ceramic color print excellent in the adhesion to the glass plate and being likely to develop a desired color tone. $T_{100}$ is particularly preferably from 400 to 450° C.

Further, the present binder resin preferably has a ($T_{100}$–$T_{90}$) of from 0.1 to 15° C. Here, $T_{90}$ represents a temperature when, at the time of raising the temperature from room temperature at a heating rate of 10° C./min by using a thermogravimetric analyzer (TG), the amount of the reduced resin is 90 wt %. When the ($T_{100}$–$T_{90}$) is at least 0.1, a small amount of the present binder resin remains even when the glass frit starts melting, whereby the ceramic color print can be fixed to the glass plate due to stickiness of both of the resin and the glass frit at a temperature near the glass transition temperature Tg of the glass frit, and the adhesion of the ceramic color print to the glass plate can be increased. Further, when the ($T_{100}$–$T_{90}$) is at most 15° C., the present binder resin can be sufficiently decomposed until the glass frit is completely melted, whereby the present binder resin is less likely to remain as chars in the ceramic color print, and it is thereby possible to obtain a ceramic color print being likely to develop a desired color tone and excellent in the adhesion to the glass plate. Particularly, the ($T_{100}$–$T_{90}$) is preferably from 5 to 15° C.

Further, in order to suppress the decrease in strength of the ceramic color print, or to prevent the ceramic color print from being attached to a press mold used at the time of press bending of the glass plate i.e. to obtain favorable mold release properties, an inorganic filler may be added to the present toner. The inorganic filler is preferably a heat resistant inorganic filler, and it is more preferably a filler comprising at least one inorganic selected from the group consisting of aluminum borate, α-alumina, potassium titanate, zinc oxide, magnesium oxide, magnesium borate, basic magnesium sulfate and titanium diboride. The shape of the inorganic filler is not particularly limited, but a plate-like filler is preferred, whereby high shielding properties in the interior of the ceramic color print can be achieved. With respect to the amount of the inorganic filler, the total amount of the fine inorganic pigment particles and the inorganic filler is within a range of the amount to satisfy the above described preferred ratio of the glass frit to the fine inorganic pigment particles. Namely, in a case where the inorganic filler is contained, it is preferred that 1≦(the glass frit)/(the fine inorganic pigment particles+the inorganic filler)≦5 by the mass ratio.

Further, other than the inorganic filler, another compounding agent may be blended as the case requires. For example, a charge controlling agent such as an azo metal-containing dye, a salicylic acid metal-containing dye or a quaternary ammonium salt may be incorporated in the toner. Such a compounding agent including the inorganic filler may be used within a range to satisfy the above requirement regarding the amount of the essential three components.

The present toner is produced, for example, by mixing the preset binder resin, the fine inorganic pigment particles, the glass frit, etc., kneading and cooling the mixture to prepare pellets, followed by pulverization and classification. The heating temperature at the time of kneading is preferably from 150 to 200° C. When the heating temperature is at least 150° C., the resin, the fine inorganic pigment particles, the glass frit, etc., can be uniformly mixed. Further, when the heating temperature is at most 200° C., decomposition of the present binder resin at the toner preparation stage can be prevented. The present toner preferably has an average particle size of from 5 to 50 μm. When the average particle size is at least 5 μm, the fine inorganic pigment particles and the glass frit in the present toner will not be exposed to the surface, and the amount of electrification of the present toner can be secured, whereby occurrence of failure of printing such as fogging due to an insufficient amount of electrification of the present toner can be suppressed at the time of electro printing. Further, when the average particle size is at most 50 μm, high definition print quality is likely to be achieved.

After the obtained present toner is printed on the glass plate by electro printing system, by heating the glass plate having the toner printed thereon to a predetermined temperature to bake the toner, a ceramic color print can be formed. On that occasion, the heating temperature is preferably from 600 to 740° C. When the heating temperature is at least 600° C., the glass frit will completely be melted, whereby the adhesion of the ceramic color print to the glass plate can be sufficiently secured over a long period of time. Further, when the heating temperature is at most 740° C., deformation of the glass plate can be prevented. In the present invention, as the glass plate, soda lime glass, non-alkali glass or quartz glass may, for example, be used.

The thickness of the ceramic color print to be formed by the present invention is preferably from 5 to 30 μm. When the thickness is at least 5 μm, stable shielding properties will be easily obtained, and when the thickness is at most 30 μm, a desired thickness will easily be achieved only by electro printing once, such being excellent in handling efficiency. The thickness is particularly preferably from 10 to 20 μm.

Figure 2:
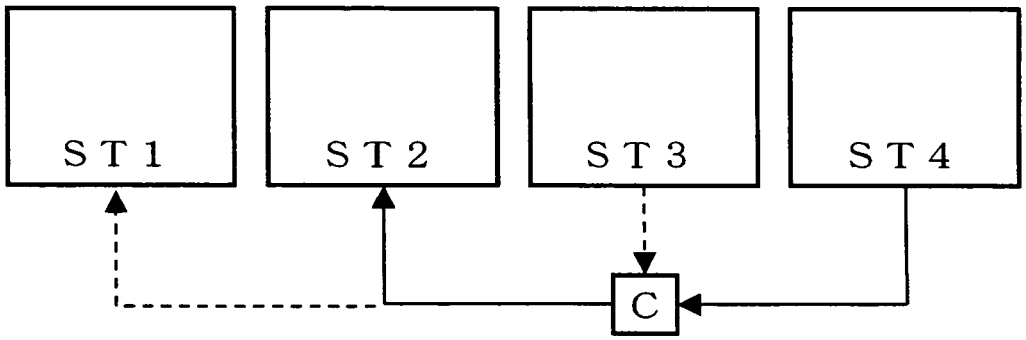
FIG. 2 is a chart schematically illustrating a control process according to a preferred embodiment of the present invention.

FIG. 2 is a chart schematically illustrating a control process according to a preferred embodiment of the present invention. On a glass plate pre-treated in ST1, a toner is printed with a predetermined pattern in the printing step ST2, and the glass plate is heated in the firing step ST3 to bake the toner, whereby a glass plate provided with a ceramic color print is produced. After the firing step ST3, the shielding performance of the formed ceramic color print is measured in the inspection step ST4. The data regarding the shielding performance measured are transmitted to a computer C which controls the pattern of the toner in the printing step. As the case requires, the temperature data in the firing step ST3 also are transmitted to the computer C. The data transmitted to the computer C are utilized as the data to judge whether desired shielding performance is obtained. In a case where it is judged that no desired performance is obtained, the toner print pattern and the toner supply amount are adjusted to achieve the desired performance by the operation of the computer C. The adjusted toner print pattern and toner supply amount are transmitted to the printing step ST2 as the feedback, and a ceramic color print is provided on the next glass plate.

When the desired shielding performance is obtained by such feedback, the control data are fixed to produce a large amount of glass plates provided with a ceramic color print continuously.

Further, in a case where the glass plate G is used for a window of an automobile, it is possible to store and accumulate data regarding shapes of glass plates depending upon the models of automobiles, data regarding pattern shapes of ceramic color prints, etc., in the computer C. Accordingly, in production of a glass plate for a certain model, commands based on data regarding the pattern shape of a ceramic color print corresponding to the model are transmitted to an electro printing machine, whereby it is easy to change printing for a certain model to printing for another model and to carry out printing depending upon each model. Further, it is possible to easily change printing for a certain model to printing for another model and to carry out cutting and chamfering depending upon each model, by transmitting commands based on data regarding the shape of a glass plate among data regarding the model to a step (ST1) of cutting and chamfering the glass plate.

Figure 3:
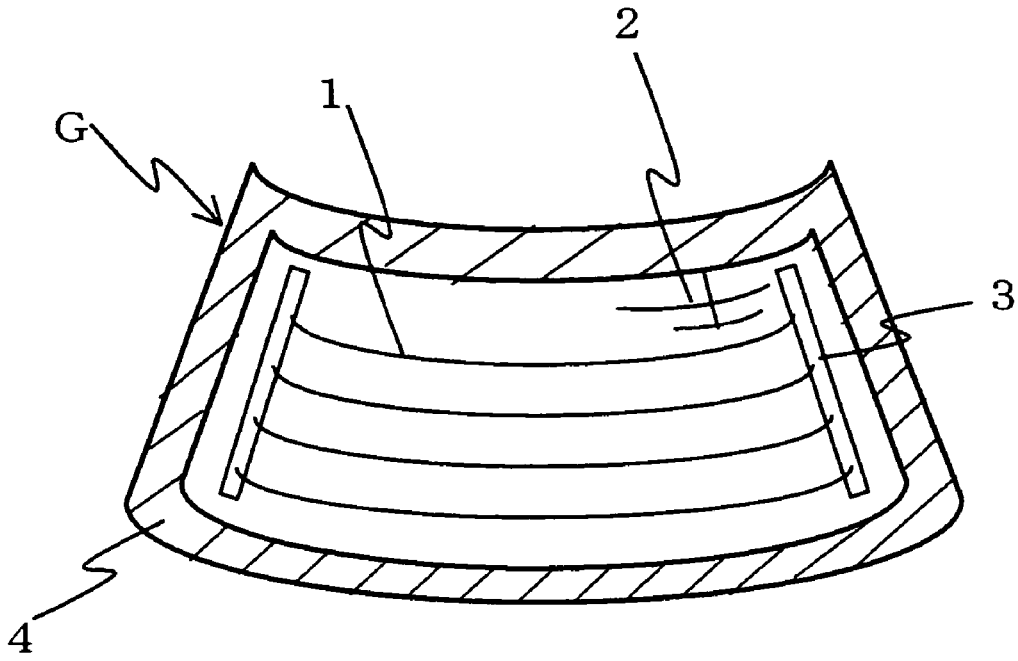
FIG. 3 is a front view illustrating one example of a rear window of an automobile.

In the printing step ST2, not only the color toner but also a toner containing fine electrically conductive particles (hereinafter referred to as an electrically conductive toner) may be printed on the glass plate. For example, on a rear window for an automobile shown in FIG. 3, electrically conductive printed wires (defogger 1, antenna wire 2, bus bar 3) are provided at a center region of a glass plate G and a dark ceramic print 4 is provided at the peripheral region. It is possible to print the electrically conductive toner together with the color toner on the glass plate by further printing the electrically conductive toner on the photoconductor drum shown in FIG. 1 with a predetermined pattern. Similar to the color toner, the electrically conductive toner has been printed by screen printing. Thus, by electro printing of the electrically conductive toner together with the color toner in such a manner, a production process suitable for mass production can be achieved.

Now, the present invention will be described in further detail with reference to Examples. However, it should be understood that the present invention is by no means restricted to such specific Examples. In Examples, with respect to the decomposition temperature, using a thermogravimetric analyzer (model: DTG-50, manufactured by Shimadzu Corporation), measurement was carried out from room temperature to 700° C. at a heating rate of 10° C./min, to determine the temperature $T_{100}$ at which there is no longer a change in the weight of the resin, and the temperature $T_{90}$ when the amount of the reduced resin was 90%.

Further, the average molecular weight of the resin used in each of Examples 1 to 10, 12 and 13 is the weight average molecular weight, and the average molecular weight of the resin used in Example 11 is the number average molecular weight.

EXAMPLE 1

In a container made of stainless steel (SUS304) having a capacity of 200 mL, 20 parts by mass of maleic anhydride-modified polypropylene (manufactured by Sanyo Chemical Industries, Ltd., trade name: Umex 110TS, average molecular weight 12,000, acid value 7, $T_{100}$=450° C., $T_{90}$=435° C.), 18 parts by mass of fine black heat resistant pigment particles comprising Cu—Cr—Mn composite oxide (manufactured by Tokan Material Technology Co., Ltd., trade name: 42-302A, average particle size 0.6 μm) and 62 parts by mass of glass frit (bismuth-silica non-lead frit, glass transition temperature Tg=461° C., melting temperature=565° C., average particle size 2 μm) were mixed, heated to 180° C. and kneaded, and then cooled to room temperature to obtain a solid. The solid was pulverized by a jet mill and classified to obtain a toner having an average particle size of 20 μm.

This toner was printed on a plate glass having a size of 30 cm×30 cm with a rectangular pattern with a line width of 10 mm and a length of 80 mm by an electro printing machine, followed by firing at 700° C. for 4 minutes to form a ceramic color print. With respect to the ceramic color print, the following evaluations were carried out. Evaluation results are shown in Table 1. In the following Examples 2 to 12 also, similar evaluations were carried out and the results are shown in Table 1. Further, a similar evaluation is carried out in Example 13, whereupon a result shown in Table 1 is obtained.

(Evaluation of Adhesion)

A portion at which the ceramic color print adhered to the glass plate was observed from the rear side of the glass plate by an optical microscope to confirm presence or absence of separation and failure in adhesion of the ceramic color print. The failure in adhesion means such a state that the ceramic color print does not adhere to the glass plate but is floating. An evaluation is made based on the following standards. A: no separation observed at all, B: 5 or less failures in adhesion with a diameter of at most 0.5 mm observed at the interface between the glass plate and the ceramic color print, C: 6 to 10 failures in adhesion with a diameter of at most 0.5 mm observed at the interface between the glass plate and the ceramic color print, D: 11 or more failures in adhesion with a diameter of at most 0.5 mm or a failure in adhesion with a diameter exceeding 0.5 mm observed, and no separation of the ceramic color print observed, E: only a part of the ceramic color print completely separated, and F: the entire ceramic color print separated. A product rated A, B or C was considered as accepted.

(Evaluation of Visible Light Transmittance)

The visible light transmittance of the ceramic color print was measured by a spectrophotometer (manufactured by MINOLTA, trade name: spectrophotometer CM-3600d), and a product having a visible light transmittance of at most 0.3% was considered as accepted.

EXAMPLE 2

A toner having an average particle size of 20 μm was obtained in the same manner as in Example 1 except that 32 parts by mass of the fine pigment particles and 48 parts by mass of the glass frit were used.

EXAMPLE 3

A toner having an average particle size of 20 μm was obtained in the same manner as in Example 1 except that 15 parts by mass of the maleic anhydride-modified polypropylene, 19 parts by mass of the fine pigment particles and 66 parts by mass of the glass frit were used.

EXAMPLE 4

A toner having an average particle size of 20 μm was obtained in the same manner as in Example 1 except that 10 parts by mass of the maleic anhydride-modified polypropylene, 20 parts by mass of the fine pigment particles and 70 parts by mass of the glass frit were used.

EXAMPLE 5

A toner having an average particle size of 20 μm was obtained in the same manner as in Example 1 except that maleic anhydride-modified polypropylene (manufactured by Sanyo Chemical Industries, Ltd., trade name: Umex 1001, average molecular weight 40,000, acid value 26, $T_{100}$=450° C., $T_{90}$=435° C.) was used.

EXAMPLE 6

A toner having an average particle size of 20 μm was obtained in the same manner as in Example 1 except that maleic anhydride-modified polypropylene (manufactured by Sanyo Chemical Industries, Ltd., trade name: Umex 1003, average molecular weight 20,000, acid value 21, $T_{100}$=440° C., $T_{90}$=430° C.) was used.

EXAMPLE 7

A toner having an average particle size of 20 μm was obtained in the same manner as in Example 1 except that maleic anhydride-modified polypropylene (a sample manufactured by Sanyo Chemical Industries, Ltd., average molecular weight 43,000, acid value 38, $T_{100}$=430° C., $T_{90}$=420° C.) was used.

EXAMPLE 8

A toner having an average particle size of 20 μm was obtained in the same manner as in Example 1 except that maleic anhydride-modified polypropylene (manufactured by Sanyo Chemical Industries, Ltd., trade name: Umex 1010, average molecular weight 30,000, acid value 52, $T_{100}$=430° C., $T_{90}$=420° C.) was used.

EXAMPLE 9

Comparative Example

A toner having an average particle size of 20 μm was obtained in the same manner as in Example 1 except that 55 parts by mass of the fine pigment particles and 25 parts by mass of the glass frit were used.

EXAMPLE 10

Comparative Example

A toner having an average particle size of 20 μm was obtained in the same manner as in Example 1 except that 50 parts by mass of the maleic anhydride-modified polypropylene, 11 parts by mass of the fine pigment particles and 39 parts by mass of the glass frit were used.

EXAMPLE 11

Comparative Example

A toner having an average particle size of 20 μm was obtained in the same manner as in Example 1 except that polypropylene (manufactured by Sanyo Chemical Industries, Ltd., trade name: VISCOL 660-P, average molecular weight 7,900, $T_{100}$=380° C., $T_{90}$=365° C.) was used instead of the maleic anhydride-modified polypropylene.

EXAMPLE 12

Comparative Example

A toner having an average particle size of 20 μm was obtained in the same manner as in Example 1 except that maleic anhydride-modified polypropylene (manufactured by Sanyo Chemical Industries, Ltd., trade name: Umex 100 TS, average molecular weight 10,000, acid value 3.5, $T_{100}$=380° C., $T_{90}$=370° C.) was used.

EXAMPLE 13

Comparative Example

A toner having an average particle size of 20 μm was obtained in the same manner as in Example 1 except that 5 polystyrene (manufactured by Sanyo Chemical Industries, Ltd., trade name: HIMER ST-120, average molecular weight 10,000, $T_{100}$=460° C., $T_{90}$=445° C.) was used instead of the maleic anhydride-modified polypropylene.

TABLE 1

| | Adhesion | Visible light transmittance (%) |
|---|---|---|
| Example 1 | A | 0.1 |
| Example 2 | A | 0.1 |
| Example 3 | A | 0.1 |
| Example 4 | B | 0.1 |
| Example 5 | C | 0.3 |
| Example 6 | B | 0.2 |
| Example 7 | B | 0.3 |
| Example 8 | A | 0.1 |
| Example 9 | D | 2.4 |
| Example 10 | E | 5.4 |
| Example 11 | E | Not measured |
| Example 12 | F | Not measured |
| Example 13 | F | Not measured |

It is understood from results shown in Table 1 that in Examples of the present invention (Examples 1 to 8) employing the present toner, a glass plate provided with a ceramic color print having favorable adhesion and having a visible light transmittance suppressed low is obtained.

The present invention relates to a process to provide a ceramic color print on a glass plate and a color toner for electro printing therefor. Particularly, the present invention is applicable to a process for producing a glass plate provided with a ceramic color print for a window of an automobile.

The entire disclosure of Japanese Patent Application No. 2005-292459 filed on Oct. 5, 2005 including specification, claims, drawings and summary is incorporated herein by reference in its entirety.

What is claimed is:

1. A color toner for electro printing, which comprises from 10 to 50 parts by mass of fine inorganic pigment particles, from 5 to 40 parts by mass of a heat decomposable binder resin having an acid value of at least 5, and from 40 to 85 parts by mass of glass frit, per 100 parts by mass of the total solid content of the toner, wherein the heat decomposable binder resin comprises an acid-modified thermoplastic resin selected from the group consisting of a maleic anhydride-modified thermoplastic resin and a maleic anhydride-modified polyolefin.

2. The color toner for electro printing according to claim 1, wherein the mass ratio of the glass frit to the fine inorganic pigment particles in the toner is such that (the glass frit)/(the fine inorganic pigment particles)≧1.

3. The color toner for electro printing according to claim 1, wherein the acid-modified thermoplastic resin is a maleic anhydride-modified thermoplastic resin.

4. The color toner for electro printing according to claim 1, wherein the acid-modified thermoplastic resin is a maleic anhydride-modified polyolefin.

5. The color toner for electro printing according to claim 1, wherein the heat decomposable binder resin having an acid value of at least 5 is a heat-decomposable resin having a $T_{100}$ of from 350 to 550° C., provided that $T_{100}$ is a temperature when, at the time of raising the temperature from room temperature at a heating rate of 10° C./min by using a thermogravimetric analyzer (TG), there is no longer a change in the weight.

6. A color toner for electro printing, which comprises fine inorganic pigment particles, a heat decomposable binder resin having an acid value of at least 5, and glass frit, characterized in that the mass ratio of the glass frit to the heat decomposable binder resin in the toner is such that (the glass frit)/(the heat decomposable binder resin)≧1.5, wherein the heat decomposable binder resin comprises an acid-modified thermoplastic resin selected from the group consisting of a maleic anhydride-modified thermoplastic resin and a maleic anhydride-modified polyolefin.

7. The color toner for electro printing according to claim 6, wherein the mass ratio of the glass frit to the fine inorganic pigment particles in the toner is such that (the glass frit)/(the fine inorganic pigment particles)≧1.

8. The color toner for electro printing according to claim 6, wherein the acid-modified thermoplastic resin is a maleic anhydride-modified thermoplastic resin.

9. The color toner for electro printing according to claim 6, wherein the acid-modified thermoplastic resin is a maleic anhydride-modified polyolefin.

10. The color toner for electro printing according to claim 6, wherein the heat decomposable binder resin having an acid value of at least 5 is a heat-decomposable resin having a $T_{100}$ of from 350 to 550° C., provided that $T_{100}$ is a temperature when, at the time of raising the temperature from room temperature at a heating rate of 10° C./min by using a thermogravimetric analyzer (TG), there is no longer a change in the weight.

* * * * *